US006616484B1

(12) United States Patent
Fan Wong

(10) Patent No.: US 6,616,484 B1
(45) Date of Patent: Sep. 9, 2003

(54) PLUG WITH A FUSE

(76) Inventor: Tsui-Tuan Fan Wong, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 10/346,945

(22) Filed: Jan. 17, 2003

(51) Int. Cl.[7] ..... H01R 13/68
(52) U.S. Cl. ..... 439/622; 439/621; 337/198
(58) Field of Search ..... 439/620, 621, 439/622, 692; 337/198, 208, 216

(56) References Cited

U.S. PATENT DOCUMENTS 2,831,087 A * 4/1958 Sundt ..... 337/198
3,659,252 A * 4/1972 Brown ..... 337/201
4,390,225 A * 6/1983 Coyne et al. ..... 439/332
4,477,139 A * 10/1984 Urani ..... 439/332
4,981,448 A * 1/1991 Herbert ..... 439/622
5,457,445 A * 10/1995 Su ..... 337/198
6,468,111 B1 * 10/2002 Weng ..... 439/622

* cited by examiner

*Primary Examiner*—P. Austin Bradley
*Assistant Examiner*—X. Chung-Trans
(74) *Attorney, Agent, or Firm*—Alan D. Kamrath; Rider Bennett, LLP

(57) ABSTRACT

A plug has a plug casing, an inner tube received in the plug casing and having two recesses oppositely defined in a top of the inner tube to receive therein a first blade and a second blade, a fuse tube having therein a spring, a fuse retainer with legs extending out therefrom and a fuse. The spring abuts the fuse retainer and the legs securely clamp the fuse. A fuse engaging ring is connected to the fuse tube. A connecting ring is engaged with the inner tube to electrically connect to the first connecting leg of the fuse engaging ring. After the connection of the connecting ring to the inner tube which has the fuse tube, the spring, the fuse retainer and the fuse therein, the fuse electrically connects to the fuse engaging ring and therefore the connecting ring.

5 Claims, 4 Drawing Sheets

PLUG WITH A FUSE

BACKGROUND OF THE INVENTION

1. Field of the Invention

The present invention relates to a plug, and more particularly to a plug with a fuse. The plug has an inner tube received in a plug casing, a fuse casing received in the inner tube and having a fuse securely received in the fuse casing so that the plug itself is able to break the circuit when there is an overload and further having an excellent waterproof characteristic.

2. Description of Related Art

Normally, a plug has two blades, two electrical wires respectively connected to a corresponding one of the two blades and a casing enclosing joints of the two blades and the two electrical wires. This kind of plug provides electricity to a cable connected to a distal end of the plug when plugged into a wall outlet. Although this kind of plug brings convenience to the user, when there is an overload in the plug, the plug is not able to detect the overload and eventually damage occurs to the electrical appliance that is using the plug for electricity supply. For the user's safety and to secure the property, a plug with a fuse is introduced into the market. The plug is able to detect an overload and cut off the power transmission automatically. Still, the plug still suffers a drawback, which is that the plug does not have any waterproof capability so as to protect the plug from a short circuit caused by exposure to water. Therefore, the user has to be very careful not to have the plug close to any place that is wet, which causes trouble to the user.

To overcome the shortcomings, the present invention tends to provide an improved plug to mitigate and obviate the aforementioned problems.

SUMMARY OF THE INVENTION

The primary objective of the present invention is to provide a plug with a fuse securely received inside the plug so that the plug is able to have excellent waterproof capability.

In order to accomplish the foregoing objective, the plug has a plug casing, an inner tube received in the plug casing, a fuse tube received in the inner tube and having therein a spring, a fuse retainer and a fuse, a fuse engaging ring connected to the fuse tube and a connecting ring engaged with the inner tube. The fuse is thus securely received in the plug casing and protected by not only the fuse tube, but also the inner tube. The plug has a highly waterproof characteristic.

Other objects, advantages and novel features of the invention will become more apparent from the following detailed description when taken in conjunction with the accompanying drawings.

DETAILED DESCRIPTION OF THE PREFERRED EMBODIMENT

Figure 1:
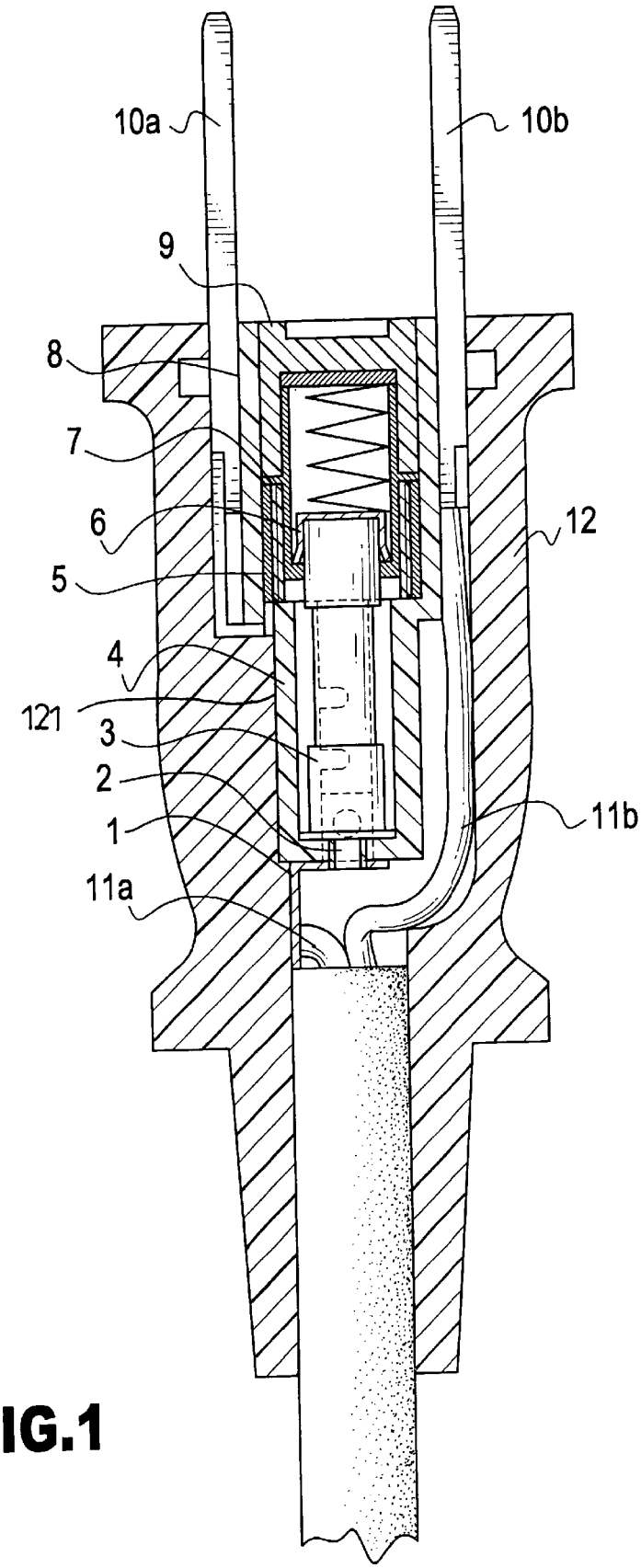
FIG. 1 is a cross sectional view showing the inner structure of the plug of the present invention.

With reference to FIGS. 1, 2, 3, 4 and 5, the plug in accordance the present invention has a hollow plug casing (12), an inner tube (4) received in the plug casing (12), a fuse tube (9) received in the inner tube (4) and having therein a spring (8), a fuse retainer (6) with legs (61) extending out therefrom and a fuse (3), a fuse engaging ring (5) connected to the fuse tube (9) and a connecting ring (1) engaged with the inner tube (4).

Figure 2:
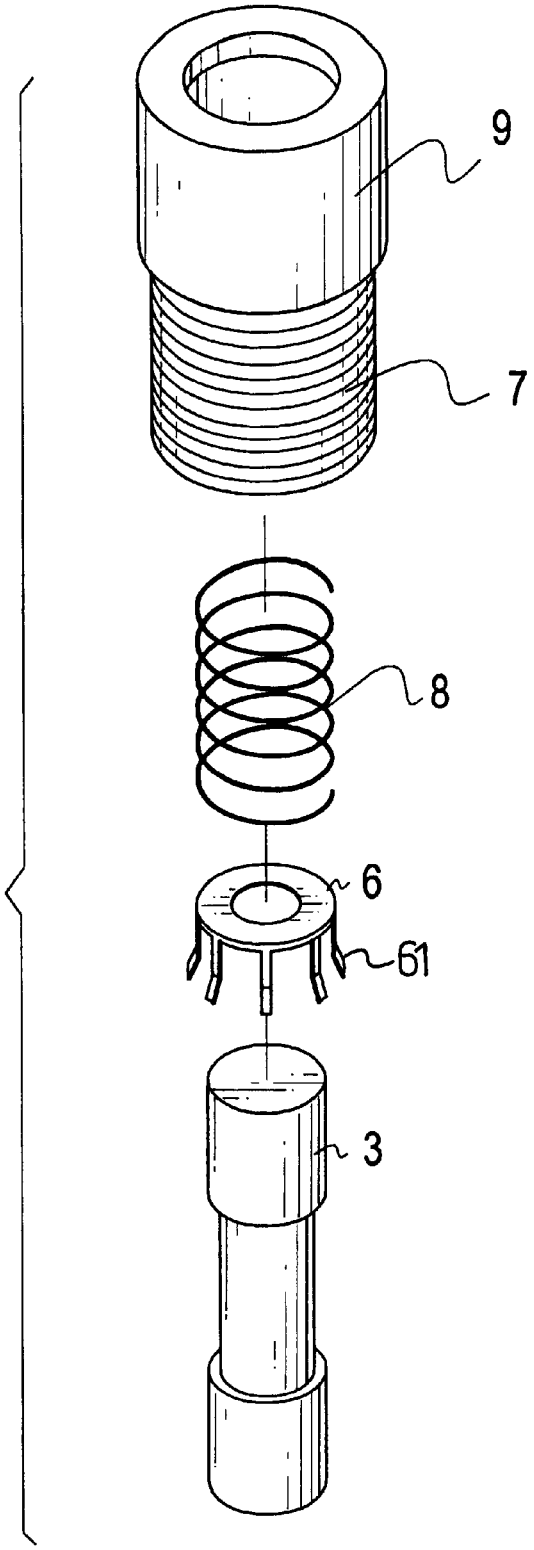
FIG. 2 is an exploded perspective view showing parts received in the fuse tube.

Referring to FIG. 2, the fuse tube (9) has a closed end and an open end with an outer threading (7) made of brass and formed around a periphery of the opening end. The fuse retainer (6) is received in the fuse tube (9) and thus sandwiches the spring (8) inside the fuse tube (9) with a face of the closed end of the fuse tube (9). After the spring (8) and the fuse retainer (6) are received in the fuse tube (9), the legs (61) of the fuse retainer (6) extend out from the open end of the fuse tube (9) so that when the fuse (3) is received in the fuse tube (9), one end of the fuse (3) is securely clamped by the legs (61) of the fuse retainer (6).

Figure 3:
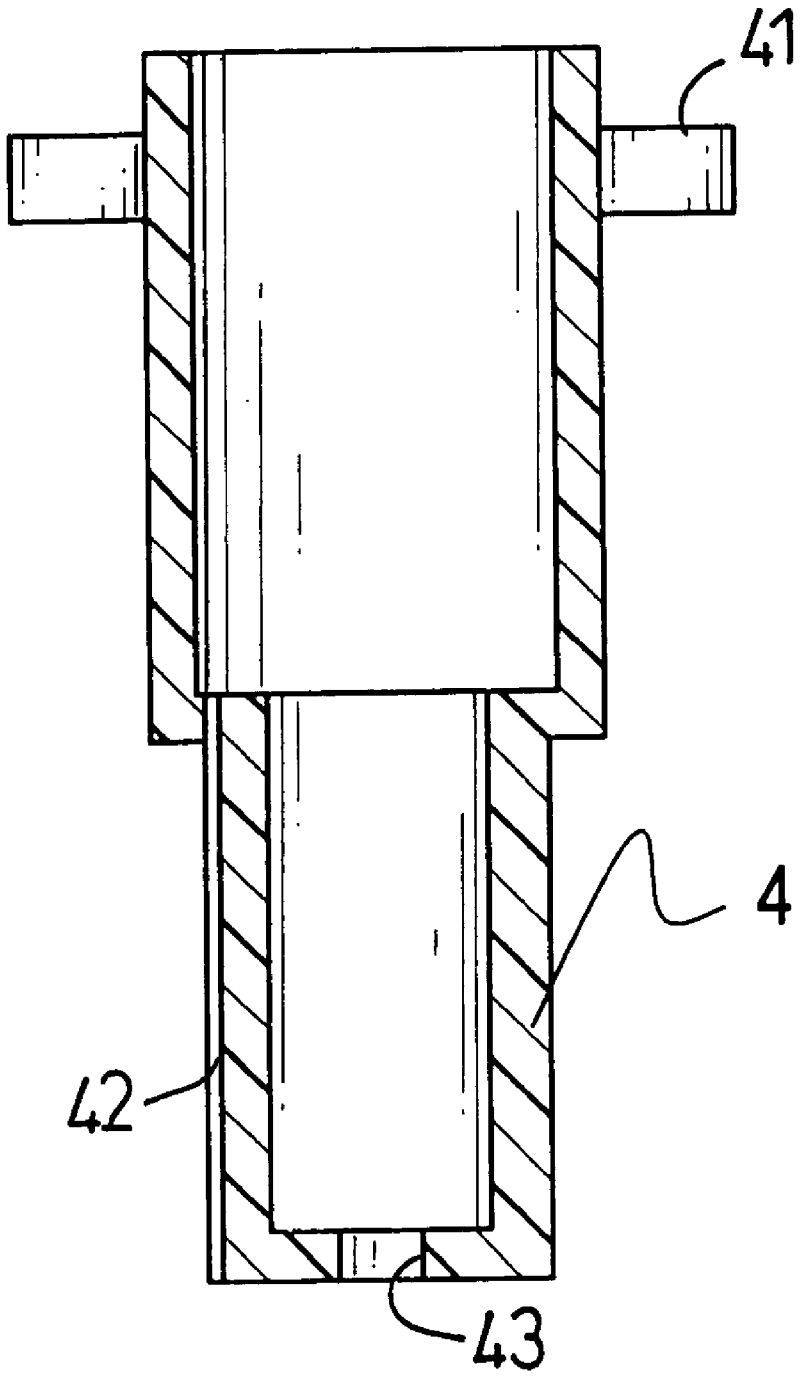
FIG. 3 is a cross sectional view showing the inner tube.
Figure 4:
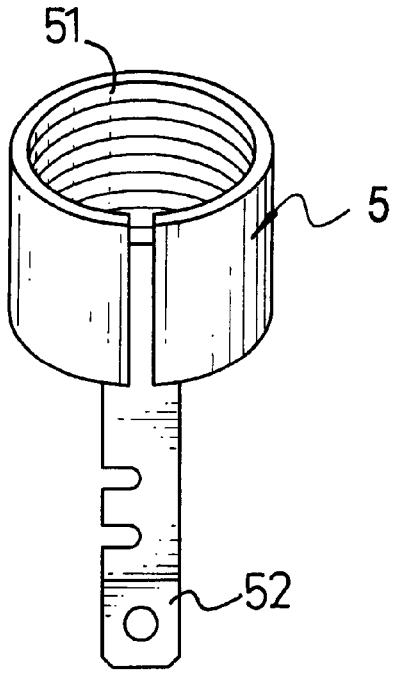
FIG. 4 is a perspective view showing the fuse engaging ring.
Figure 5:
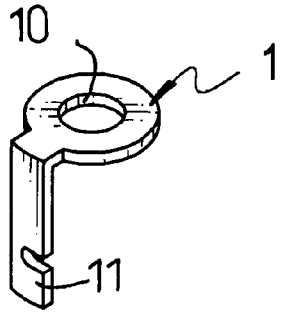
FIG. 5 is a perspective view of the connecting ring.

Referring to FIGS. 3, 4, 5 and taking FIG. 1 for reference, after the spring (8), the fuse retainer (6) and the fuse (3) are received in the fuse tube (9), the combination is then threadingly connected to the fuse engaging ring (5) with an inner threading (51) formed to correspond to the outer threading (7) of the fuse tube (9) and a first connecting leg (52) extending out from the fuse engaging ring (5).

The inner tube (4) has two recesses (41) respectively corresponding to one of the two connecting blades (10*a*, 10*b*), a slit (42) longitudinally defined in an outer periphery of the inner tube (4) to correspond to a ledge (121) formed on an inner face of the plug-casing (12) and a hole (43) defined in a bottom of the inner tube (4). The connecting ring (1) has a through hole (10) defined to correspond to the hole (43) of the inner tube (4) and a second connecting leg (11) extending out from the connecting ring (1).

After the combination of the fuse tube (9) and the fuse engaging ring (5), the fuse (4) is electrically connected to the fuse engaging ring (5). Thereafter, the combination of the fuse tube (9) and the fuse engaging ring (5) is received in the inner tube (4) and then the connecting ring (1) is connected to the inner tube (4) with a rivet (2) extending through the aligned through hole (10) and the hole (43) of the inner tube (4). After the connection of the connecting ring (1) to the inner tube (4), the first connecting leg (52) electrically connects to the second connecting leg (11). Then, the second connecting leg (11) connects to a first wire (11*a*) and a second wire (11*b*) connects directly to a second blade (10*b*), wherein the first wire (11*a*) and the second wire (11*b*) are from a cable as shown in FIG. 1. After the assembly, it is noted that the fuse (3) electrically connects to the fuse engaging ring (5) which, in turn, electrically connects to the connecting ring (1). Therefore, the entire connection of the plug is completed.

Because the fuse is securely received in the fuse tube (9) and the fuse tube (9) is then received in the inner tube (4) so that the plug of the present invention has excellent waterproof characteristic.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug comprising:

a hollow plug casing;

an inner tube received in the plug casing and having two recesses oppositely defined in a top of the inner tube to receive therein a first blade and a second blade respectively;

a fuse tube received in the inner tube and having an open end and a closed end, the fuse tube having therein a spring, a fuse retainer with legs extending out therefrom and a fuse, wherein the spring is sandwiched between a face of the closed end and the fuse retainer and the legs of the fuse retainer securely clamp the fuse;

a fuse engaging ring connected to the fuse tube and having a first connecting leg extending out therefrom; and a connecting ring engaged with the inner tube and having a second connecting leg extending out therefrom to electrically connect to the first connecting leg, wherein a first wire connects the second connecting leg and a second wire connects to the second blade, whereby after the connection of the connecting ring to the inner tube which has the fuse tube, the spring, the fuse retainer and the fuse therein, the fuse electrically connects to the fuse engaging ring and therefore the connecting ring.

2. The plug as claimed in claim 1, wherein the fuse tube has an outer threading made of brass.

3. The plug as claimed in claim 2, wherein the fuse engaging ring has an inner threading corresponding to the outer threading of the fuse tube.

4. The plug as claimed in claim 1, wherein the inner tube has a hole defined in a bottom of the inner tube to correspond to a through hole defined in the connecting ring so that a rivet is able to extend through the hole and the through hole to combine the connecting ring and the inner tube.

5. The plug as claimed in claim 3, wherein the inner tube has a hole defined in a bottom of the inner tube to correspond to a through hole defined in the connecting ring so that a rivet is able to extend through the hole and the through hole to combine the connecting ring and the inner tube.

* * * * *